US010072446B2

(12) United States Patent
Müller et al.

(10) Patent No.: US 10,072,446 B2
(45) Date of Patent: Sep. 11, 2018

(54) DOOR HANDLE UNIT HAVING A SAFETY FUNCTION

(71) Applicant: Huf Hülsbeck & Fürst GmbH & Co. KG, Velbert (DE)

(72) Inventors: Dirk Müller, Essen (DE); Markus Bartels, Mülheim (DE); Reinhold Mathofer, Wülfrath (DE); Ralf Lennhoff, Hagen (DE); Timo Hoppe, Wülfrath (DE); Mario Christensen, Mülheim (DE); Andreas Beck, Bochum (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 495 days.

(21) Appl. No.: 14/421,892

(22) PCT Filed: Aug. 16, 2013

(86) PCT No.: PCT/EP2013/067178
§ 371 (c)(1),
(2) Date: Feb. 16, 2015

(87) PCT Pub. No.: WO2014/027099
PCT Pub. Date: Feb. 20, 2014

(65) Prior Publication Data

US 2015/0218854 A1 Aug. 6, 2015

(30) Foreign Application Priority Data

Aug. 16, 2012 (DE) ..... 10 2012 016 184

(51) Int. Cl.
*E05B 85/00* (2014.01)
*E05B 85/10* (2014.01)
(Continued)

(52) U.S. Cl.
CPC ..... *E05B 85/10* (2013.01); *E05B 77/06* (2013.01); *E05B 85/16* (2013.01); *Y10T 292/57* (2015.04)

(58) Field of Classification Search
CPC ..... Y10S 292/22; E05B 77/06; E05B 77/04; E05B 77/12; E05B 77/02
See application file for complete search history.

(56) References Cited

U.S. PATENT DOCUMENTS 3,719,248 A * 3/1973 Breitschwerdt ..... E05B 77/06 180/271
5,743,575 A 4/1998 McFarland
(Continued)

FOREIGN PATENT DOCUMENTS

CN 101456404 6/2009
CN 101460691 6/2009
(Continued)

OTHER PUBLICATIONS

International Preliminary Report on Patentability dated Feb. 17, 2015 From the European Patent Office Re. Application No. PCT/EP2013/067178 and Its Translation Into English.
(Continued)

*Primary Examiner* — Mark A Williams

(57) ABSTRACT

The invention relates a door handle unit (10) for actuating a lock (101) of a movable part (100) of a motor vehicle, particularly a door, a flap or the like, with a door handle (11), which is movably mounted at the support element (12) for mechanically opening the movable part (100) by a user, wherein the door handle (11) comprises at least a rest position and a operative position, a mechanical coupling element (13), which is movably mounted at the support element (12) and by which a movement of the door handle (11) is transmitted to the lock (101) from the rest position to the operating position, wherein the door handle (11) and the
(Continued)

Ia

Figure 1A:
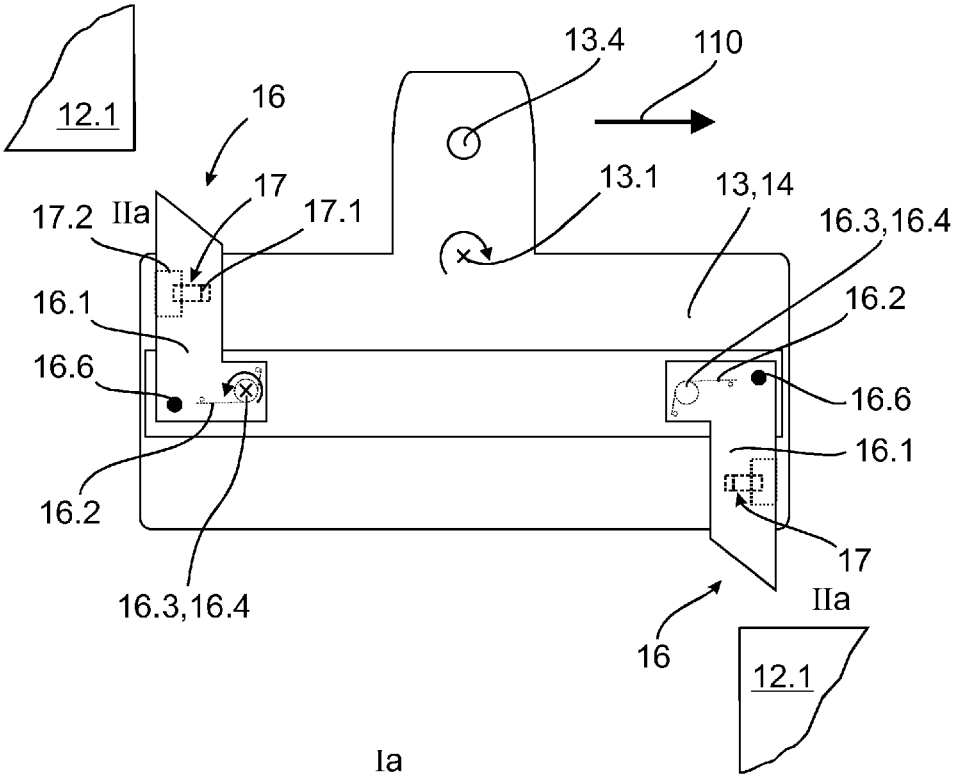

Ib coupling element (13) are mechanically cooperating and form a movable actuating mechanism (15), and at least a locking unit (16), which in a normal case enables a movement of the actuating mechanism (15) for actuating the lock (101) and only in a case of locking blocks a movement of the actuating mechanism (15) for actuating the lock (101). According to the invention it is provided that the blocking unit (16) can be activated for a case of blocking (Ib) via a remarkable movement of the actuating mechanism (15).

15 Claims, 8 Drawing Sheets

(51) Int. Cl.
*E05B 77/06* (2014.01)
*E05B 85/16* (2014.01)

(56) References Cited

U.S. PATENT DOCUMENTS 6,471,262 B1 * 10/2002 Schwab ..... E05B 77/06 242/384.6
6,575,508 B2 * 6/2003 Stuart ..... E05B 77/06 292/336.3
8,029,032 B1 * 10/2011 Yang ..... E05B 77/06 292/336.3
8,783,742 B2 * 7/2014 Puscas ..... E05B 77/06 292/336.3
9,637,953 B2 * 5/2017 Bendel ..... E05B 77/06
2009/0102206 A1 * 4/2009 Lee ..... E05B 77/06 292/336.3
2011/0120022 A1 5/2011 Papanikolaou et al.

FOREIGN PATENT DOCUMENTS

| | | |
|---|---|---|
| CN | 202090726 | 12/2011 |
| CN | 102317558 | 1/2012 |
| DE | 19910513 | 9/2000 |
| DE | 202010014992 | 1/2012 |
| JP | 2012-021326 | 2/2012 |
| WO | WO 2005/106167 | 11/2005 |
| WO | WO 2014/027099 | 2/2014 |

OTHER PUBLICATIONS

Notification of Office Action and Search Report dated Mar. 14, 2016 From the State Intellectual Property Office of the People's Republic of China Re. Application No. 201380043587.8 and Its Translation of Office Action Into English.
International Search Report and the Written Opinion dated Feb. 5, 2014 From the European Patent Office Re. Application No. PCT/EP2013/067178 and Its Translation Into English.

* cited by examiner

Ia, IIa

Ia, IIa

Ia, IIa

DOOR HANDLE UNIT HAVING A SAFETY FUNCTION

RELATED APPLICATIONS

This application is a National Phase of PCT Patent Application No. PCT/EP2013/067178 having International filing date of Aug. 16, 2013, which claims the benefit of priority of German Patent Application No. 10 2012 016 184.0 filed on Aug. 16, 2012. The contents of the above application are all incorporated by reference as if fully set forth herein in their entirety.

FIELD AND BACKGROUND OF THE INVENTION

The present invention is directed to a door handle unit for actuating a lock of a movable part of a motor vehicle, particularly a door, a flap or such according to the preamble of claim 1. Thereby the door handle unit comprises a door handle which is movably supported on a support element for the mechanical opening of the movable part by a user, wherein the door handle can at least take a resting and an operating position. Moreover, the door handle unit is supplied with a mechanical coupling element, which is movably supported on the support element, and is transferable by a movement of the door handle from the resting position into the operating position towards the lock, wherein the door handle and the coupling element are mechanically cooperating and form a movable actuating mechanism. Moreover, the door handle unit comprises at least a blocking unit, which in the normal case enables a movement of the actuating mechanism for actuating the lock and only in the blocking case blocks a movement of the actuating mechanism for actuating the block. Further, the present invention is also directed to a method for securing a door handle unit.

From the state of the art generic door handle units are known, which comprise a crash lock or crash latch. In this context for example the document DE 199 29 022 A1 has to be mentioned, which discloses a crash lock for a generic door handle unit. The particularity of this crash lock is that it is supplied with a low mass, so that it is faster movable due to the low mass inertia as the heavier movable parts of the door handle unit. If now accelerations due to a crash act on the door handle unit, they cause that initially the fast crash lock blocks the other heavier movable parts of the door handle unit in a formfitting way. Thereby it can be avoided that an accidental deployment of the door handle unit in a crash and consequential resulting accelerations occur.

However, it has turned out with multiple crash investigations that such crash locks can flutter, so that nevertheless an undesired release of the door handle unit can occur, what in any case has to be avoided. With the previously described crash lock for the door handle unit it does not depend on whether the movable door handle itself is actually moved or not, since the crash lock is solely actuated due to impacting forces from the crash acceleration, which are directly acting on the crash lock.

SUMMARY OF THE INVENTION

An object of the present invention is to provide a door handle unit and a method for securing a door handle unit, which possess an improved security, particularly in a crash case or during an accident. Particularly, it is an object of the present invention to directly block the movement of the actuating mechanism from the door handle and the coupling element if these are unintentionally moving during a crash.

The present invention is solved by a door handle unit for actuating a lock of a movable part of a motor vehicle, particularly a door flap or such with the features of claim 1, particularly from the characterizing clause. Moreover, for solving the objections a method for securing such a door handle unit, particularly from the characterizing clause, is proposed. In the depending device and method claims preferred improvements of the invention are specified. Features which are disclosed for the door handle unit according to the invention thereby apply also for the safety method according to the invention and vice versa. Moreover, the method described herein can be realized with a door handle unit according to the invention. Advantageous embodiments of the door handle unit according to the invention and the method according to the invention are specified in the depending claims.

With the door handle unit according to the invention according to the preamble of claim 1 it is intended that the locking unit is activatable for the blocking case by a remarkable movement of the actuating mechanism. Thereby the blocking unit is not activated as itself by the crash, but only in the case if the actuating mechanism performs a remarkable movement. Thereby the blocking unit is activated by the movement of the activating mechanism and not by the acting accelerations to the door handle unit, which are present in case of a crash. By a remarkable movement of the actuating mechanism it is understood within the scope of the invention that it is fitful and/or fast. Accordingly, the remarkable movement is not based on a normal movement of the door handle in order to open the movable part like a door or a flap. However, the locking unit is activated meaning without an accident if the user for example rips or fitfully pulls the door handle. In such a case the crash unit would, like described in document DE 199 29 022 A1, not lead to a blocking of the actuating mechanism, since no direct accelerations act on the crash lock. Thereby it is clear that the present blocking unit is not activated due to crash accelerations, which are acting on a motor vehicle during crash, but by an actual relative movement of the actuation mechanism to the supporting element or movable part. Thereby the remarkable movement is solely based on a relative movement of the actuating mechanism towards the support element or movable part. A normal movement of the door handle by its user, however, does not lead to an activation of the blocking unit, so that the whole door handle unit is unrestrictedly usable and functional. The previously described case represents the normal case during an actuation of the door handle unit.

With the door handle unit according to the invention it can be intended that the blocking unit comprises at least one movable blocking latch which formfittingly blocks the actuating mechanism in a blocking case. Hereby the resulting formfit, particularly between the blocking latch and the support element or the movable part, particularly an outlet or a projection thereof, is realized. Thereby the door handle unit according to the invention is securely blocked via an occurring formfit in the activating state of the blocking unit. Thereby also a further movement of the actuating mechanism is excluded, so that no further accidental deployment can occur.

Further, it can be intended in the scope of the door handle unit according to the invention that at least a blocking latch can be transferred from the releasing position in the blocking position via a releasing force. In the release position the blocking unit resides in the normal case, so that the door handle unit according to the invention can be safely normally actuated in order to open the lock at the movable part. In the blocking position the blocking unit is in the case of emergency (the so called case of blocking), so that the blocking latch formfittingly blocks the actuating mechanism. Thereby a normal actuation of the actuating mechanism is excluded, so that the lock cannot be opened at the movable part. The previously described releasing force results from the remarkable movement of the actuating mechanism, which leads to a swinging and/or pivoting movement of the blocking unit. By this swinging and/or pivoting movement of the blocking unit a centrifugal force acts on the blocking unit, particularly on the blocking latches, so that the centrifugal force represents the releasing force for the latches. By the impact of the releasing force the blocking latches are transferred from their releasing positions to their blocking positions by pivoting. In the blocking position each a mechanical stop for each blocking latch is intended, so that these cannot be overwinded or stays in the blocking position at least during the impact of the releasing force.

Likewise, it is possible within the scope of the invention that at least a blocking latch of the blocking unit is mounted in the releasing position via a spring element. By this spring element the blocking latch is forced into the releasing position. In case of blocking the releasing force acts on the blocking latch in a way that this acts against the spring force of the spring element and the blocking latch is transferred from the releasing position into the blocking position. The corresponding spring element can be shaped as a leave spring or torsion spring and particularly about a pivoting point of the blocking latch. By the use of the spring element it can be ensured that after a blocking case the blocking latch is transferred from the blocking position back into the releasing position by a spring load as soon as the door handle is transferred to its resting position and also the corresponding actuating mechanism has taken its resting position. Subsequently the door handle unit according to the invention can be usually used (meaning subsequent to the blocking case). Thereby also rescue workers are able to free passengers from a motor vehicle in a simple manner after an accident.

Moreover, it is possible within the scope of the invention that at least a blocking latch of the blocking unit during a change from the releasing position into the blocking position mechanically locks in the blocking position via a locking connection. Thereby the blocking unit permanently blocks an actuation of the actuating mechanism with a generated form fit, so that an undesired release of the lock for opening the movable part is prevented in a secure manner. With this embodiment the door handle unit is, however, after a unique release or activation of the blocking unit not actuatable anymore by the door handle in order to open the lock for the movable part. However, this embodiment comprises the advantage that a flutter of the blocking unit according to the invention can be safely prohibited since the blocking latch is unalterable formfittingly blocked by the available snap-on connection.

According to the invention one or multiple blocking units can be intended with the door handle unit. A blocking unit can thereby comprise one or multiple blocking latches. A blocking unit can also comprise a modular composition, so that for example it can be clipped-on an actuating mechanism. Further, it is also possible that the blocking unit is engaged in a recess in the actuating mechanism, whereby the complete function of the handle unit according to the invention can be established.

Further, the door handle unit according to the invention can additionally comprise at least a crash lock, like described in the state of the art of DE 199 29 022 A2. Further, it is appropriate if a door handle unit according to the invention also comprises a counter balance weight, which is ideally mechanically connected with or even integrated in the coupling element.

With the door handle unit according to the invention it can be intended that the blocking unit is mounted directly at or with the actuating mechanism. Thereby no additional transmission element is necessary in order to move the blocking unit, since it is directly connected with the actuating mechanism and thereby the movement of the actuating mechanism directly acts on the blocking unit.

Likewise, it is possible that the blocking unit is indirectly connected with an actuating mechanism and mechanically cooperates with a transmission element. In case the blocking unit is indirectly connected with an actuating mechanism, it can comprise a separate housing, in which a movable rocker is assembled about a pivoting point or a pivoting access. Ideally the housing is stationary assembled at the door handle unit or at the movable part. Within the housing then the previously described T-like rocker is pivotably mounted at or in the housing. Moreover, at least one outlet is assembled in the housing with which the blocking latch formfittingly cooperates in a blocking case or it's blocking position. At the rocker then at least a blocking latch, preferably two blocking latches, are assembled, which in the blocking position commits the desired formfit, particularly with an outlet in the housing. The movement of the actuating mechanism can be transferred to the rocker of the blocking unit via a transmitting element wherein the transmitting element is particularly performed as a Bowden cable or chain or the like. The advantage of the indirectly assembled blocking unit is to be seen in that it can be assembled at a random position of the door handle unit or even at the movable part.

Likewise it is possible with the indirect assembly of the blocking unit with the actuating mechanism that the movement of the actuating mechanism does not only occur via the transfer element, but that additionally a translation unit, particularly in form of a gear, is intended. Hereby the translation relation can be optimized in order to, for example, achieve a fast activation of the blocking unit by means of a minimal movement of the actuating mechanism. The previously described gear can be shaped as a lever gear, gear wheel or such in order to alternate the translation relation of the movement of the actuating mechanism to the blocking unit.

Likewise, the present objection of the invention can be solved by a method for securing a door handle unit 10. Hereby it is intended according to the invention that the blocking unit is activated for a blocking case by a remarkable movement of the actuating mechanism. Thereby the method according to the invention can be performed with a door handle unit according to some embodiments of the present invention.

Further features and advantages of the present invention result from the claims, the subsequent description and the drawings. Likewise, the disclosed features from the door handle unit according to the invention also apply for the method according to the invention and vice versa. In the drawings, the invention is shown in diverse embodiments. Thereby the features described in the claims and in the description can each individually or in any combination be essential for the invention. It is shown:

BRIEF DESCRIPTION OF THE SEVERAL VIEWS OF THE DRAWINGS(S)

Figure 1B:
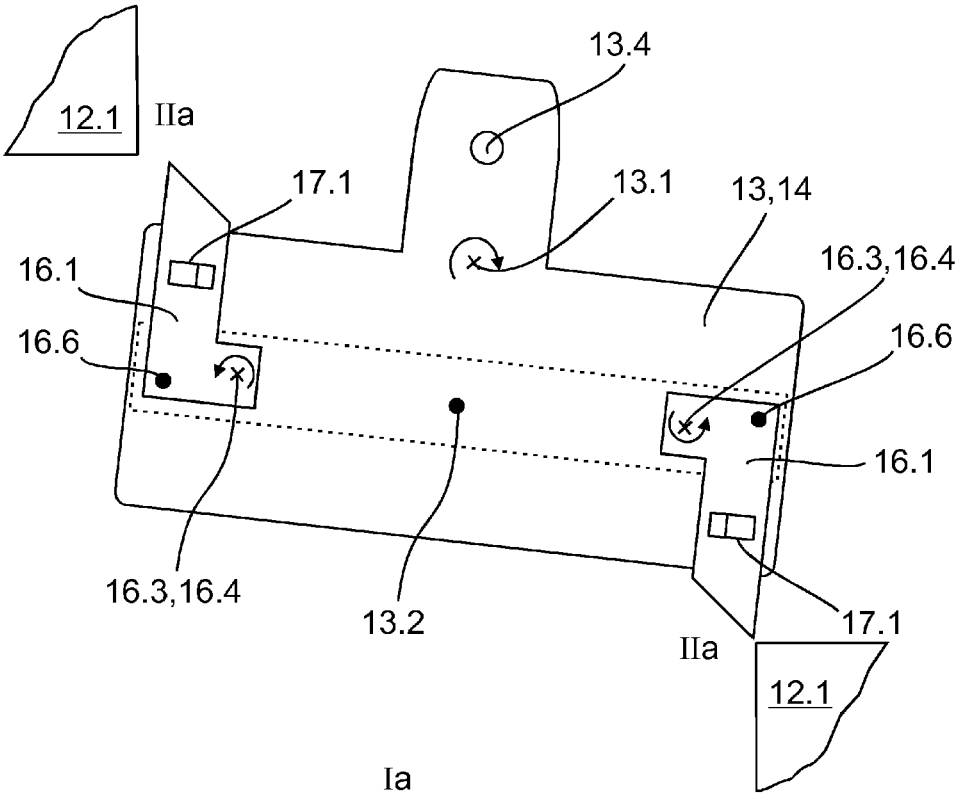
Figure 1C:
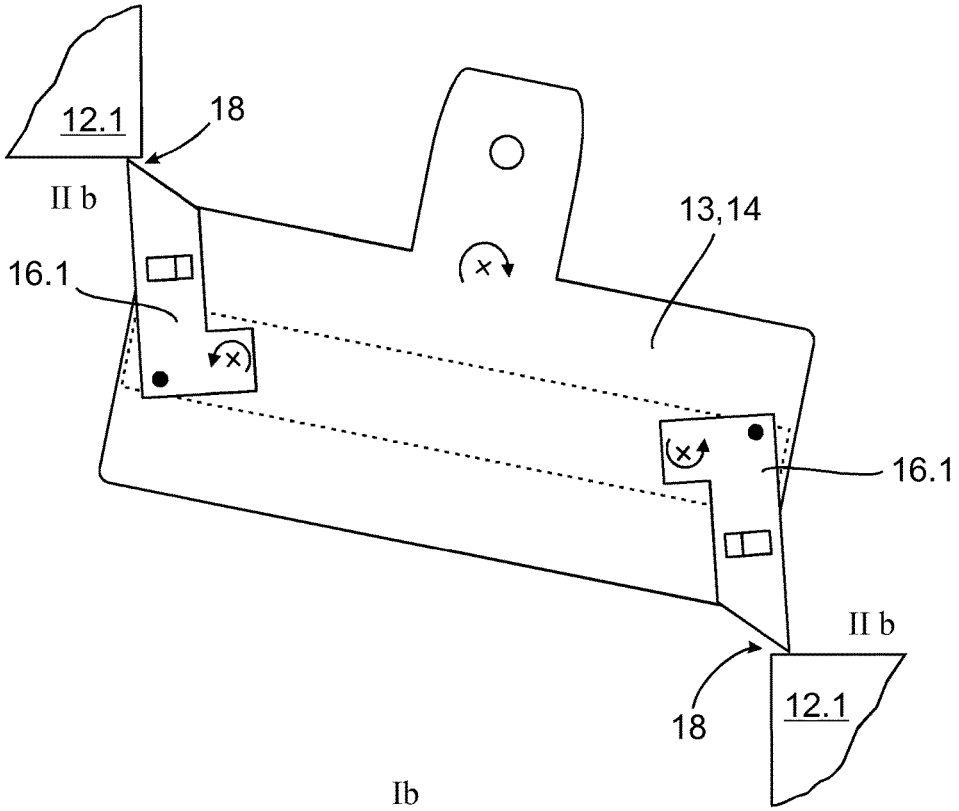
Figure 2:
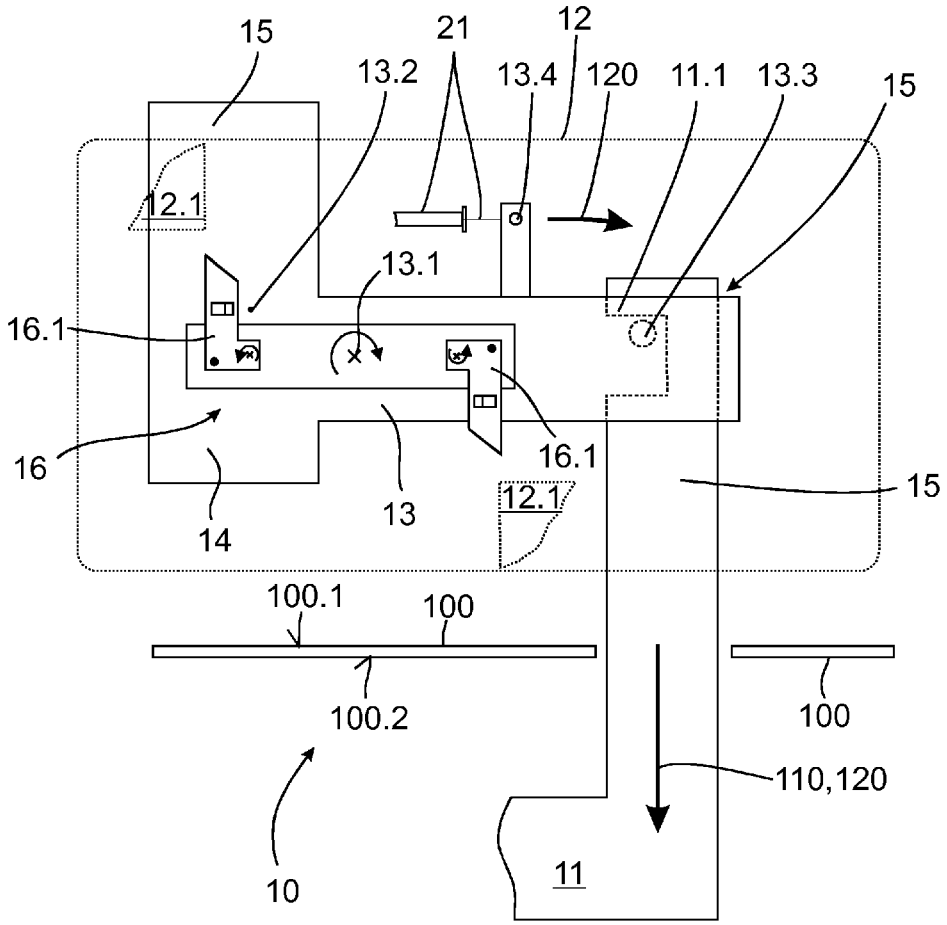
Figure 3:
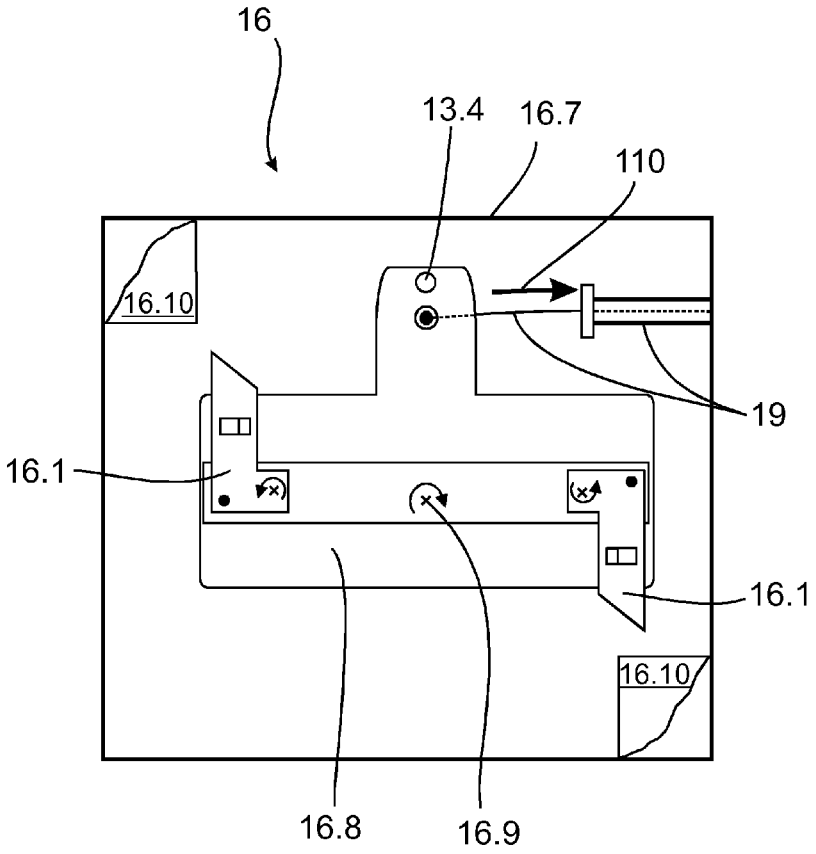
Figure 4A:
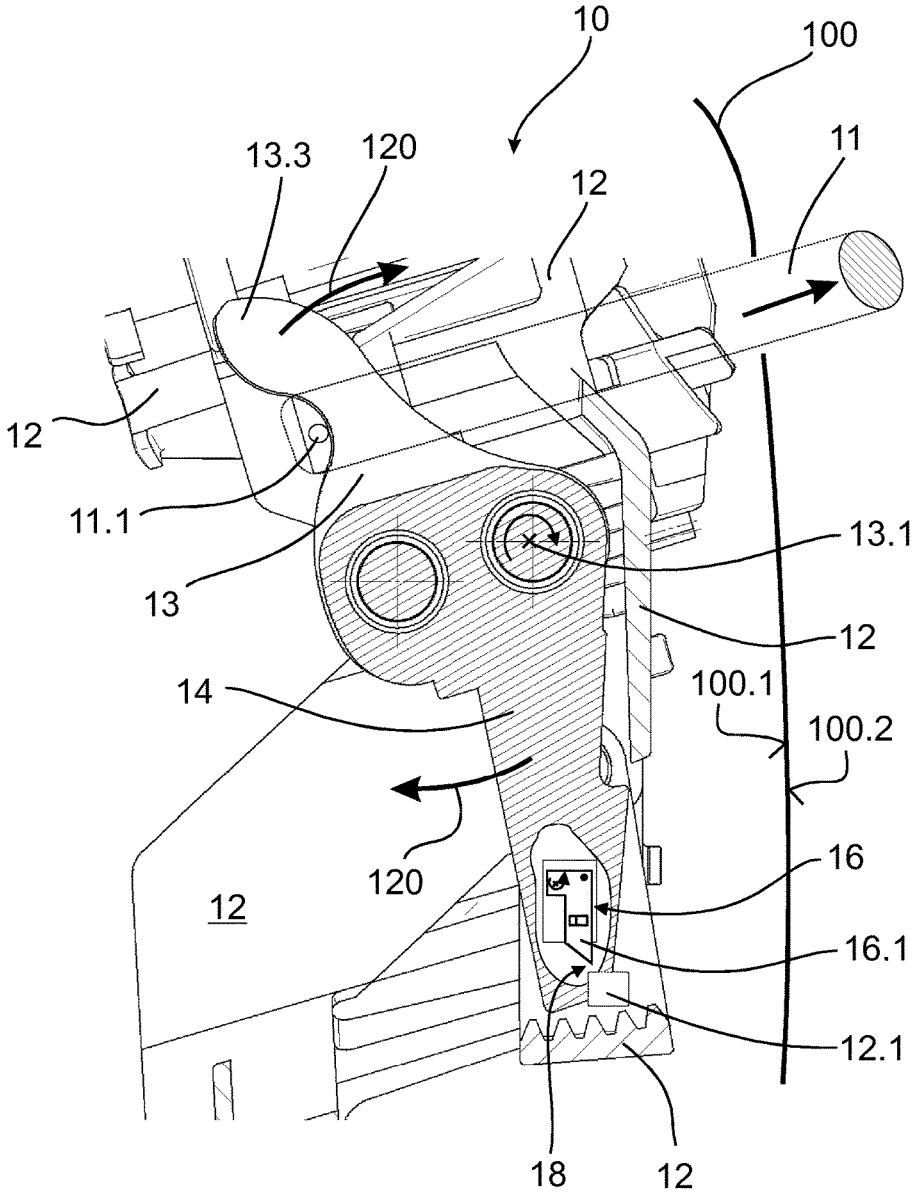
Figure 4B:
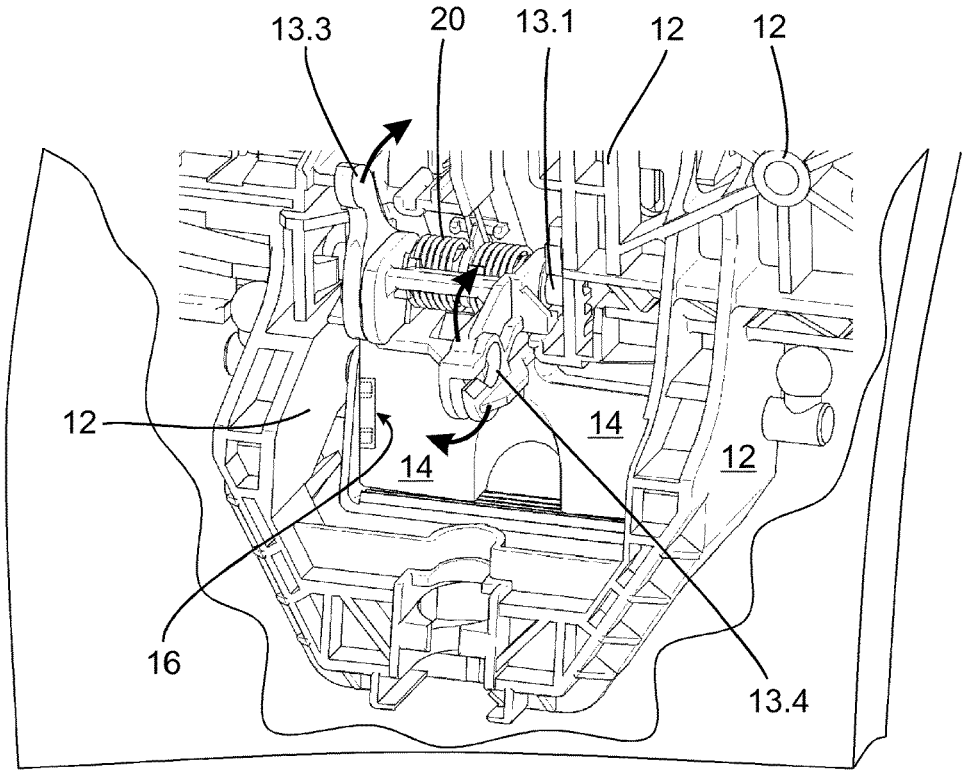
Figure 5:
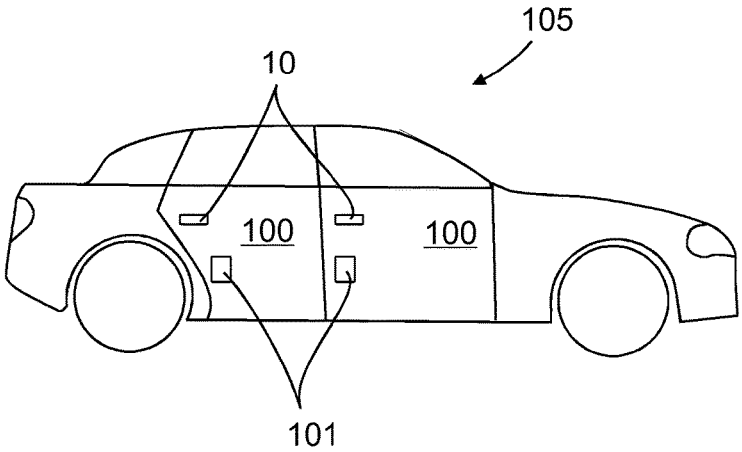

FIG. 1*a* a schematic drawing of a blocking unit at a door handle unit according to the invention during the normal case and in a releasing position of the blocking unit, FIG. 1*b* a comparable drawing of the blocking unit from FIG. 1*a* during a normal actuation of the door handle unit, so that the blocking unit remains in a releasing position, FIG. 1*c* a comparable drawing to FIG. 1*b* wherein however the blocking case of 1*b* occurs by a remarkable movement at the actuating mechanism and the blocking unit is assembled in a blocking position, FIG. 2 a schematic drawing of the door handle unit according to the invention with a modular assembled blocking unit in releasing position, FIG. 3 a schematic drawing of a blocking unit, which can be indirectly assembled at the door handle unit and connected via a transmission element, FIG. 4*a* a sectional view through a door handle unit according to the invention with a modular assembled blocking unit at the counter balance weight in its releasing position, FIG. 4*b* a 3-dimensional view of a comparable door handle unit from FIG. 4*a* with a left handed blocking unit at the counter balance weight with two block latches, and FIG. 5 a schematic drawing of a motor vehicle with a door handle unit according to the invention.

DESCRIPTION OF THE SPECIFIC EMBODIMENTS OF THE INVENTION

In the figures identical reference numbers are utilized for the same technical features also in different embodiments.

In FIGS. 1*a* to 1*c* the functionality of the door handle unit 10 according to the invention is schematically shown. Thereby FIG. 1*a* shows a coupling element 13 of the actuating mechanism 15 which is pivotably mounted about a pivot axis 13.1. Additionally an acceptance 13.4 is intended at the coupling element 13 wherein a release means 21, which is shown in FIG. 2 as a Bowden cable and serves as a transmission means for the lock 101, can be mechanically coupled for the mechanic actuating of the lock 101. By a rotation of the coupling element 13 about the pivot point 13.1 an actuation of the release means 21 occurs, whereby the lock 101 is mechanically actuated wherein a movable part 100 can be opened, which is shaped as a door flap or such at a motor vehicle 100. The coupling element 13 can be supplied with a counter balance weight 14 like shown in FIG. 2. Further it is possible that, however, the coupling element 13 represents a separate component for the counter balance weight element 14. The counter balance weight 14 serves for balancing or at least partially compensating the appearing mass inertia forces, which act on the door handle unit 10, particularly the movable door handle 11 during a crash, in order to prevent during a crash of the motor vehicle that the door handle 11 undesirably moves from the resting position in the operating position via the acting acceleration forces of the crash.

In FIGS. 1*a* and 1*b* the normal case Ia with a normal appropriate actuating of the door handle 11 is shown and thereby the produced movement of the actuating mechanism 15 with the coupling element 13 and, if necessary, the counter balance weight block 14. In this normal case Ia also the blocking unit 16 according to the invention is in its release position IIa, in which the blocking unit 16 is quasi inoperable, and a movement of the actuating mechanism 15 for actuating the lock 101 is unhindered possible. Based on FIG. 1*a*, in which the pivotably mounted coupling element 13 is in a resting position of the door handle 11 this coupling element 13 turns by an actuation of the door handle 11 between the resting position and the operating position about the pivoting point 13.1, whereby the coupling element 13 utilizes this pivoting movement for actuating the lock 101. With this rotation of the coupling element 13 in the normal case the blocking unit 16 remains quasi inoperable meaning it is not activated. In contrast to both FIGS. 1*a* and 1*b*, in FIG. 1*c* a comparable drawing of the coupling element 13 is shown, in which the rotation movement is formfittingly 18 blocked by both available blocking units 16. Thereby a further rotation of the coupling element 13 about the pivoting point 13.1 is not further possible, since both available blocking units 16 block this further rotation by the generated formfit 18.

Like shown in FIGS. 1*a* to 1*c* it is further shown in the present case of the door handle unit 10 according to the invention a total of two blocking units 16 being spaced apart to the pivoting point 13.1 the coupling element 13 is assembled. These two blocking units 16 comprise approximately the same distance to the pivoting point 13.1 in the present case and are assembled at different sides of the coupling element 13. A blocking unit 16 comprises itself a pivoting or swinging blocking latch 16.1, which is directly mounted with the coupling element 13 via a pivoting axis 16.4. In the FIGS. 1*a* and 1*b* the particular blocking latches 16.1 of the blocking unit 16 are shown in its releasing position IIa. Moreover, in FIG. 1*a* each a spring element 16.2 for the respective blocking latch 16.1 is drawn. This spring element 16.2 performs a spring force to the blocking latch 16.1 in order to force it into the releasing position IIa. According to FIG. 1*a* the spring element 16.2 is shaped as a coil spring, which mechanically cooperates with the corresponding stops at the coupling element 13 and the respective blocking latch 16.1. Additionally, in FIGS. 1*a* to 1*c* also optional locking connections 17 are shown between the respective blocking latch 16.1 and the coupling element 13. This locking connection 17 is for example realized by a notch 17.1 at the blocking latch 16.1, which mechanically or formfittingly cooperates with an opening 17.2 in which the coupling element 13 or the actuating element 15. By a pivoting movement of the blocking latch 16.1 the notch 17.1 slides at the edge of the opening 17.2 until it formfittingly mechanically locks behind the edge of the opening 17.2. Thereby it is not possible anymore for the blocking latch 16.1 to be moved back from the rotated blocking position IIb into the releasing position IIa. Also the additionally intended spring element 16.2 cannot transfer the blocking latch 16.1 from the blocking position IIb into the releasing position IIa via a corresponding spring force. However, the additional spring element 16.2 serves that the blocking latch 16.1 does not unintendedly move from the releasing position IIa in the blocking position IIb.

Like further shown in FIG. 1*b*, no activation of the blocking unit 16 results from an appropriate actuation of the door handle 11. In this normal case Ia only a usual movement of the actuating element 15 occurs. In this case the blocking unit 16 remains inactive and persists in its releasing position IIa. Like shown according to FIG. 1*b* the tapered edges of the L-like blocking latch 16.1 move thereby at provided outlets 12.1 and without contacting these. The outlets 12.1 are stationally assembled at the support element 12 or the movable part 100 and formfittingly act with the respective blocking latch 16.1 in the blocking position IIb. Like already said, both L-like blocking latches from FIG. 1*b* remain in their releasing position IIa and thereby are not contacting the intended outlets 12.1, so that altogether the blocking unit 16 remains inactive.

In FIG. 1*c* the coupling element 13 is shown, which performs a part of the movable actuating mechanism 15 with a remarkable movement of the actuation element 15. With this remarkable movement the actuating mechanism 15 turns with a certain speed so that a corresponding resulting releasing force 110 acts from the available centrifugal force to the pivotably mounted blocking latches 16.1. By the releasing force 110 the respective blocking latch 16.1 is pivoted about its pivot point 16.3 or the therefore intended pivot axis 16.2 until its blocking position IIb. In this blocking position IIb a blocking latch is particularly formfittingly kept via a stop element, so that a further turning of the blocking latch 16.1 beyond the blocking position IIb is not possible. Due to the low mass of the respective blocking latch 16.1 these are immediately turning about its pivoting axis 16.3 once a remarkable movement of the actuating mechanism 15 occurs.

Like shown in FIG. 1*c* it can be further recognized that the turned blocking latches 16.1 correspond in their blocking position IIb in a formfitting way with the respective intended outlets 12.1 at the support element 12. Thereby a formfit 18 between the blocking latches 16.1 in the blocking position IIb and the outlets 12.1 is performed. Due to the formfit the actuating mechanism 15 cannot be further turned whereby also an actuation of the mechanic lock 101 is not possible anymore since the previous movement of the actuation mechanism 15 is not sufficient in order to actuate the lock 101. In this way it is ensured that an undesired opening of the lock 110 is securely prevented by the present blocking unit 16. Due to the optional intended locking connection 17 it can be additionally achieved that the block latch 16.1 cannot anymore be transferred from its blocking position IIb to the releasing position IIa. The previously described functionality of the blocking unit 16 according to the invention with the blocking latch 16.1 with the cooperation with the outlet 12.1 is similar in each embodiment so that in the following it is not newly described.

In FIG. 2 it is only schematically shown the door handle unit 10 according to the invention with its essential elements and components. Thereby the movable door handle 11 is shaped as a pulling handle in the direction of the arrow 120. However, this movable door handle 11 can also be an actuation recess or a pivoting pull handle or such. The movement of the door handle 11 is transferred via an outlet 11.1 at the door handle 11 to an actuator 13.3 of the coupling element 13. Hereby a turning of the coupling element 13 about the pivot axis 13.1 or the pivot point 13.1 is generated. This pivot point can also be the center between both pivot points 16.3 or both blocking units 16. In the present case the blocking unit 16 is shaped modular and is assembled in a recess in the coupling element 13. Thereby both blocking latches 16.1 extrude laterally from the recesses of the coupling element 13 in order to generate the desired formfit 18 with both outlets 12.1 of the support element 12 in a blocking case Ib. The whole door handle unit 10 is assembled via the support element 12 at the movable part 100, particularly at the internal side 100.1. Thereby also both outlets 12.1 from the support element 12 are stationary, particularly independent from the actuating mechanism 15 or the coupling element 13 at the door handle unit 10. The corresponding pivot axis 16.4 for the blocking latch 16.1 of the blocking unit 16 can at the same time serve as holding elements 16.5 for the modular assembled blocking unit 16. For example at present screws can serve as holding elements 16.5 and pivot axes 16.4. The functionality of the corresponding blocking unit 16 is previously described in detail. Like further shown in FIG. 2, a pull movement at the door handle 11 in the direction of the arrow 120 leads to a turning of the coupling element 13 to a clockwise turning of the coupling element 13 about the pivot point 13.1. Hereby the releasing means 21 for the lock 101 is pulled through the corresponding assembly 13.4 at the support element 12 in the direction of the arrow 120. Thereby in the normal case la the mechanic lock 101 can be opened by an actuation of the door handle 11 from its rest position to its operating position.

In FIG. 3 a further embodiment of the door handle unit 10 according to the invention is shown. Hereby the blocking unit 16 is indirectly connected via a transmission element 19 with the actuating mechanism 15 with which it mechanically cooperates. In this case the blocking unit 16 can be assembled at the support element 12 or the movable part 100. Particularly the blocking unit 16 is placed within the housing 16.7, in which each an outlet 16.10 for the blocking latches 16.1 is intended. This outlet 16.10 can be a part of the housing 16.7 or the support element 12 or the movable part 100. The particular at the present blocking unit 16 from FIG. 3 is to be seen in the fact that this can be coupled as a separate component at an available door handle unit 10 via the transmission element 19. Additionally the acceptance 13.4 for the releasing means 21 can also come off from the rocker-like 16.8 shaped blocking unit 16 in order to block the mechanical transmission for the lock 101. The transmission element 19 is shown in FIG. 3 for example as a Bowden cable. With this embodiment it is also possible that between the actuation element 15 and the separate blocking unit 16 a gear is interconnected in order to achieve a specific transmission relation. Like previously described this gear can be performed as a lever gear or as a wheel gear or such like in order to generate the desired transmission relation. With the separate blocking unit 16 a pivotable rocker 16.8 is applicable, which is ideally pivotable about its center of mass 16.9 as a pivoting point. Further, with preferably the same distance two blocking latches 16.1 are assembled to the pivoting point 16.3 or the center of mass 16.8. Both blocking latches 16.1 are also pivotable at the T-like rocker 16.8 assembled in order to achieve the desired formfit 18 with the previously described outlet 16.10 in the blocking case Ib.

In further FIGS. 4*a* and 4*b* a detailed shape of the door handle unit 10 according to the invention with essential details is shown. Thereby the door handle unit 10 comprises a support element 12, which serves for the assembly of the whole door handle unit 10 at the movable part 100. Like recognizable at both FIGS. 4*a* and 4*b* the support element 12 is assembled at the internal side 101 of the movable part 100 and the movable door handle 11 extrudes through an opening in the movable part 100 through the external side 102. At the stably assembled support element 12 a pivotable coupling element 13 is assembled via a pivoting point 13.1. At the same time this coupling element 13 comprises a center balance weight 14 so that both components represent an integral element. The complete form of the integral coupling element 13 is lever-like or rocker-like, whereby the upper area above the pivoting point 13.1, serves as an actuator 13.3 for the movable door handle 11. Hereby a recess at the actuator 13.3 is intended, which formfittingly cooperates with the outlet 11.1 of the door handle 11. In the lower area the coupling element 13, which lies underneath the pivoting point 13.1, is a blocking unit 16 according to the invention with exactly one blocking latch 16.1, which functionally cooperates with an outlet 12.1 of the support element 12 in the blocking case Ib. In FIG. 4*a* also each the blocking unit 16 according to the invention can be intended coming from different sides of the coupling elements 13 in order to increase the stability and safety of the door handle unit 10 according to the invention. In FIG. 4*a* also the respective movement directions 120 for the movable door handle 11 or the thereby resulting pivot movements of the coupling elements 13 are shown.

In a further FIG. 4*b* a 3-dimensional view of the door handle unit 10 from FIG. 4*a* but without the movable door handle 11 is shown. For a better clarification also the blocking unit 16 according the invention is shown with a dashed line at the left side of the coupling element 13. Also at the right side of the coupling element 13 a corresponding blocking unit 16 can be assembled, which is optically concealed by the support element 12. Likewise in FIG. 4*b* also the acceptance 13.4 for the release means 21 is shown.

In the FIGS. 4*a* and 4*b* the actuating mechanism 15 with the door handle 11 is in its resting position. Also the blocking unit 16 according to the invention is shown in the releasing position IIa in the normal case Ia.

In FIG. 5 a vehicle as a motor vehicle 105 is shown in a lateral view. Thereby both lateral doors are clearly recognizable, which each represent a movable part 100. Likewise the therefore intended locks 101 underneath the door handle unit 10 according to the invention are shown at the lateral doors. By the door handle unit 10 according to the invention a movement of the actuating mechanism 15 for actuating the lock 100 is reliably blocked in the blocking case.

LIST OF REFERENCE NUMBERS AND CORRESPONDING PARTS

10 door handle unit
11 door handle
11.1 paragraph for 13.3
12 support element
12.1 paragraph for 18 respectively 16
13 coupling element
13.1 pivot point/pivot axis
13.2 center of mass
13.3 an actuator for 11
13.4 the acceptance for 21
14 center balance weight
15 mechanism
16 blocking unit
16.1 blocking latch
16.2 spring element
16.3 pivot points
16.4 pivot axis
16.5 holding elements
16.6 center of mass
16.7 housing
16.8 rocker
16.9 center of mass of 16.8
16.10 outlet at the housing
17 rest connection
17.1 the notch to 16.1
17.2 the opening in 15
18 formfit, formfitting
19 transmission element
20 spring element for 13, 14
21 releasing means for 101
100 movable part
100.1 internal side
100.2 external side
101 the lock
105 vehicle
110 for actuating the lock
120 arrow for movement direction
Ia normal case
Ib case of blocking
IIa release position
IIb blocking position

What is claimed is:

1. A door handle unit for actuating a lock of a movable part of a motor vehicle, the door handle unit comprising:

door handle, the door handle being movably mounted at a support element for mechanically opening the movable part by a user, wherein the door handle comprises at least a rest position in which the door handle is configured to hold the lock closed and the door handle comprising an operative position in which the door handle is configured to hold the lock open, a mechanical coupling element, which is movably mounted at the support element, the mechanical coupling element coupled to the door handle, and the mechanical coupling element configured to be coupled to the lock such that a movement of the door handle from the rest position to the operating position is to be transmitted to the lock, wherein the door handle and the coupling element mechanically cooperate to form a movable actuating mechanism, and at least one blocking unit, the at least one blocking unit configured in a first case to enable a movement of the actuating mechanism for actuating the lock in a normal operating condition and the at least one blocking unit in a second case configured to block the movement of the actuating mechanism for actuating the lock during a vehicle crash condition, wherein the at least one blocking unit is activatable for blocking via a level of movement of the actuating mechanism relative to the support element, wherein the level of movement is indicative of deceleration due to a vehicle crash, said at least one blocking unit comprising at least one blocking latch pivotally mounted to the mechanical coupling element, said deceleration pivotally operating said at least one blocking latch to attain a blocking position, said at least one blocking latch being pivotally movable relative to the mechanical coupling element or relative to the actuating mechanism and said at least one blocking latch configured to positively block the actuating mechanism by abutting the support element.

2. The door handle unit according to claim 1, wherein, each of said at least one blocking latch of the at least one blocking unit is configured to be movable between:

a release position for the first case; and the blocking position, for the blocking case; wherein each of said at least one blocking latch can be traversed from the release position into the blocking position, and from the blocking position into the release position, and wherein the traversal from the locking position to the release position is in a releasing direction, the releasing direction provided for each latch by a respective releasing force, there being a variation between respective releasing forces.

3. The door handle unit according to claim 1,
wherein,
the at least one blocking latch is spring-loaded and mounted in a release position.

4. The door handle unit according to claim 1,
wherein,
the at least one blocking latch comprises a fixed pivot point from the at least one blocking unit and the at least one blocking latch is pivotable between a release position and the blocking position.

5. The door handle unit according to claim 1,
wherein,
the rotation of the blocking latch from a release position into the blocking position occurs in the case of blocking via the level of movement of the actuating mechanism, wherein the at least one blocking unit mechanically moves with the actuating mechanism.

6. The door handle unit according to claim 1,
wherein,
the at least one blocking latch of the at least one blocking unit mechanically connects via a locking connection in the blocking position during a change from the release position to the blocking position.

7. The door handle unit according to claim 1,
wherein,
the level of movement of the actuating mechanism depends on a sudden and/or fast movement.

8. The door handle unit according to claim 1,
wherein the at least one blocking latch comprises a formfitting shave to provide said blocking of the actuating mechanism.

9. The door handle unit according to claim 1,
wherein,
the at least one blocking unit mechanically blocks, in the case of blocking, via the locking connection such that the actuating mechanism is permanently blocked by formfitting.

10. The door handle unit according to claim 1,
wherein,
the at least one blocking unit is directly attached to the actuating mechanism wherein the formfitting occurs in case of blocking by at least one blocking latch, which is arranged between the movable actuating mechanism and the support element or the movable part.

11. The door handle unit according to claim 1,
wherein,
the at least one blocking unit mechanically cooperates with the actuating mechanism indirectly via a transmission element wherein the blocking unit is assembled at the support element or the movable part.

12. The door unit according to claim 1,
wherein,
the at least one blocking unit mechanically cooperates with the actuating mechanism via a transmission element.

13. The door handle unit according to claim 1,
wherein,
the at least one blocking unit comprises a modular composition wherein the whole locking unit can be mounted simply and completely at the door handle unit.

14. The door handle unit according to claim 1,
wherein,
a counter balance weight element is provided for counterbalance weight of the actuating mechanism, which is stably assembled to the coupling element and wherein the at least one blocking unit can be directly assembled at the counter balance weight element.

15. The door handle unit according to claim 1,
wherein,
said at least one blocking latch can be transferred from the release position into the blocking position by a releasing force.

* * * * *